United States Patent [19]

Imaizumi

[11] 4,275,876

[45] Jun. 30, 1981

[54] ELECTROPHOTOGRAPHIC COPYING APPARATUS

[75] Inventor: Masaru Imaizumi, Shinshiro, Japan

[73] Assignee: Minolta Camera Kabushiki Kaisha, Osaka, Japan

[21] Appl. No.: 30,648

[22] Filed: Apr. 16, 1979

[30] Foreign Application Priority Data

Apr. 15, 1978 [JP] Japan ..... 53-50115[U]

[51] Int. Cl.[3] ..... B65H 31/22; B65H 31/00

[52] U.S. Cl. ..... 271/8 R; 271/207; 271/213; 355/3 SH

[58] Field of Search ..... 271/8 R, 3, 1, 7, 162, 271/163, 164, 213, 200, 201, 293, 207; 355/3 R, 3 SH

[56] References Cited

U.S. PATENT DOCUMENTS

| | | | |
|---|---|---|---|
| 3,632,201 | 1/1972 | Granzow | 355/3 SH |
| 3,997,262 | 12/1976 | Doi et al. | 355/3 R |
| 4,021,108 | 5/1977 | Ozaki et al. | 355/3 R |
| 4,116,429 | 9/1978 | Van Buskirk et al. | 271/293 |
| 4,116,556 | 9/1978 | Tanaka | 355/3 SH |

*Primary Examiner*—Bruce H. Stoner, Jr.
*Assistant Examiner*—Brian Bond
*Attorney, Agent, or Firm*—Wenderoth, Lind & Ponack

[57] ABSTRACT

Electrophotographic copying apparatus comprising a body proper and a copy paper transporting unit which can be slidably withdrawn from the body proper in the feeding direction of the copy paper. The transporting unit houses the entire path of the copy paper, thus permitting easy removal of jammed paper from the apparatus upon withdrawal of the transporting unit from the body proper.

18 Claims, 7 Drawing Figures

ELECTROPHOTOGRAPHIC COPYING APPARATUS

BACKGROUND OF THE INVENTION

The present invention relates to an electrophotographic copying apparatus, and more particularly to a mechanism for withdrawing a copy paper transporting unit from the body proper of a copying apparatus.

Generally, a copying apparatus developed in recent years is so constructed that at least a part of the apparatus which is constituted by various elements, such as copy paper transporting means, developing means and cleaning means, is made into a unit for withdrawal from the body proper thereof so as to make inspection of the apparatus, replacement of the photosensitive member or removal of jammed copy paper simple. One example of such a copying apparatus is shown in U.S. Pat. No. 4,017,169 in which a copy paper transporting unit combined with a corona transfer station is mounted for lateral withdrawal from the interior of the copying apparatus in a direction perpendicular to the feeding direction of the copy paper. However, the problem with this unit is that if copy paper is jammed at a position in which one end of the paper is nipped by a pair of feeding rollers and the other end of the paper extends into the unit, the paper may be torn since the unit is withdrawn in a direction perpendicular to the feeding direction of the copy paper. Further problems with this unit are that the mechanisms for releasing the unit from, and for locking the unit with, the copying apparatus are relatively complicated, and their operations are quite troublesome.

Japanese Unexamined Patent Application SHO No. 53-12335 published on Feb. 3, 1978 discloses an image transfer type copying apparatus with a copy paper transporting unit constructed so as to be able to be withdrawn in the feeding direction of the copy paper. Such unit extends from a feeding station, including a paper feeding roller, to an image transfer station or all the way to the paper discharging end. However, in this apparatus, if copy paper is jammed in the vicinity of the feeding roller, the paper cassette, containing a stack of copy paper, must at first be removed in order to extract the jammed paper, since the unit itself includes the feeding roller as well as the cassette.

SUMMARY OF THE INVENTION

It is accordingly a primary object of the present invention to provide a copy paper transporting unit for use in an electrophotographic copying apparatus, which is free of the aforementiond drawbacks and which permits easy inspection of the apparatus and removal of jammed copy paper.

Another object of the present invention is to provide an improved mechanism for withdrawing a copy paper transporting unit from the body proper or interior of a copying apparatus.

Still another object of the present invention is to provide a copy paper transporting unit with simple releasing and locking mechanisms so as to enable easy operation in withdrawing the unit.

These and other objects of the present invention are achieved by providing a copy paper transporting unit which extends from the front of the feeding rollers to the discharge end of a copying apparatus, which unit can be withdrawn in the feeding direction of the copy paper and has a mechanism which includes at least a first locking member at the side of the body proper of the apparatus, a second locking member on the unit side for engagement with said first locking member, and releasing means for releasing the locking engagement of said first and second locking members.

For a fuller understanding of the nature and objects of the present invention, reference is made to the following detailed description taken in conjunction with the accompanying drawings.

BRIEF DESCRIPTION OF THE DRAWINGS

FIGS. 2A and 2B are side views of a mechanism for locking and releasing the copy paper transporting unit in a copying apparatus, in which FIG. 2A shows the locked condition and FIG. 2B shows the released condition of the mechanism;

DETAILED DESCRIPTION OF THE INVENTION

Figure 1:
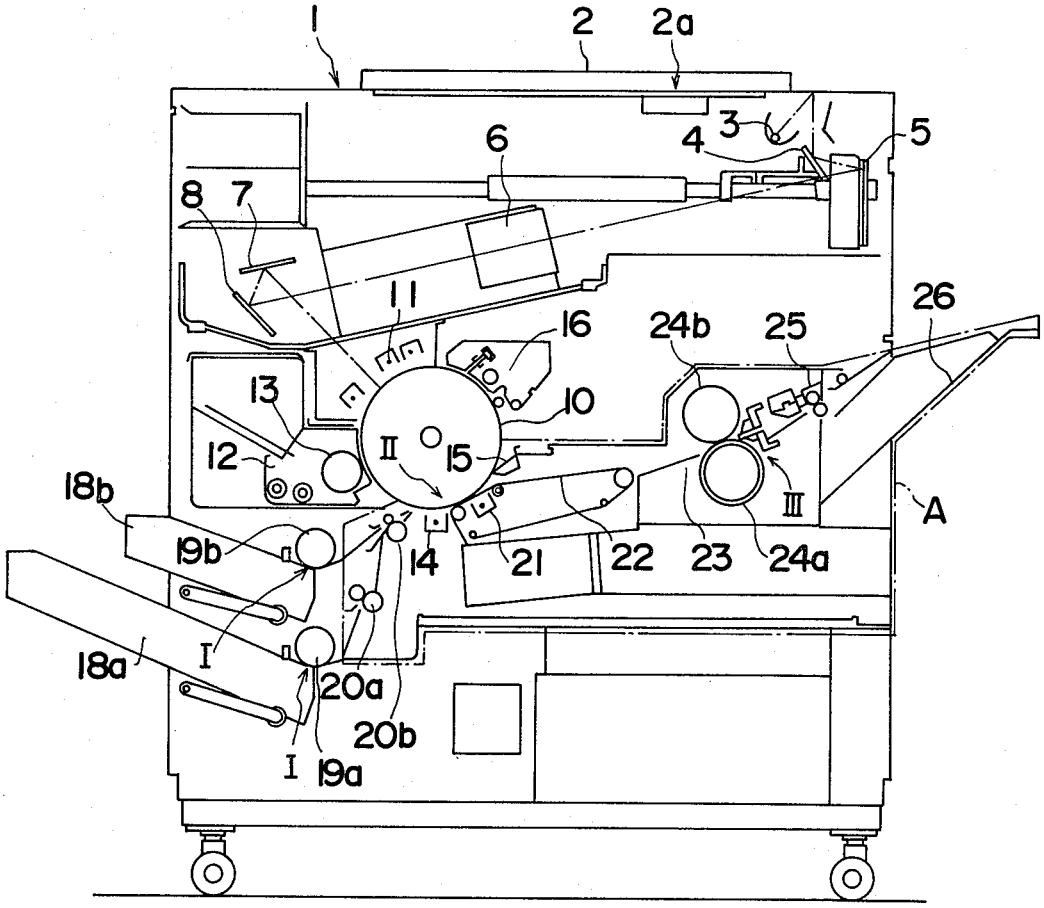
FIG. 1 is a general cross-sectional view of an electrophotographic copying apparatus which incorporates the copy paper transporting unit of the present invention.

Referring to FIG. 1, there is shown in image transfer type copying apparatus 1 incorporating a copy paper transporting unit A according to an embodiment of the present invention. An original document to be copied is placed on a transparent glass plate 2a of an original table 2 and is exposed and projected successively onto a photosensitive drum 10 by an optical scanning means including an exposure lamp 3, a first reflecting mirror 4, a second reflecting mirror 5, a projection lens 6 and first and second fixed mirrors 7 and 8. As is well known in the art, first reflecting mirror 4 together with lamp 3 are moved parallel to the original document at twice the speed of second reflecting mirror 5 so as to scan the image of the original and project it onto photosensitive drum 10 through lens 6 and fixed mirrors 7 and 8. Disposed around the photosensitive drum 10 in the direction of rotation thereof are corona charging means 11 for uniformly charging the surface of photosensitive drum 10, a developing means 12 including a magnetic developing roller 13 for developing an electrostatic latent image formed on drum 10, a corona transfer charging means 14 for transferring the developed image onto copy paper, a corona strip charging means 21 for aiding separation of the copy paper from drum 10, a stripping pawl 15 for separating the copy paper from the drum 10, and a cleaning means 16 for removing residual toner from drum 10.

Stacks of sheets of copy paper of different sizes are stored in first and second paper cassettes **18*a* and 18*b* from which the sheets are adapted to be fed, one by one, by first and second feeding rollers 19*a* and 19*b*. Each of these feeding rollers 19*a* and 19*b* rests on the topmost sheet of copy paper and is driven intermittently at a speed just sufficient to feed the copy paper to succeeding transporting rollers 20***a* and 20*b*. Copy paper is then fed between drum 10 and corona transfer charging means 14 where the developed image is successively transferred onto the copy paper, which is then transported onto an endless transporting belt 22 rotatably supported by a plurality of drive rollers. From here, the copy paper, with the toner image thereon, is further transported to a fixing means 23 having a pair of heating rollers 24*a* and 24*b*. As the copy paper is fed between rollers 24*a* and 24*b*, the toner image is fused thereon, and the paper is finally discharged out of the apparatus onto a paper receiving tray 26 by a pair of discharging rollers 25.

Generally, a copy paper fed by feeding roller 19*a* or 19*b* along a feeding path leading to the discharging end of the apparatus most often becomes jammed in one of the following areas. The first area is the paper feeding section I in the vicinity of first or second feeding roller 19*a* or 19*b*. Paper jamming at this section is most often caused by misfeeding of the topmost sheet of copy paper by feeding roller 19*a* or 19*b*. More specifically, two or more sheets of paper may be fed simultaneously, or paper may be fed obliquely, thereby causing jamming at this section. The second area where jamming often occurs is in the area of the image transfer section II, and this is primarily caused by failure of the copy paper to separate from the surface of photosensitive drum 10. Finally, the third area of jamming is the fixing section III, where heating rollers 24*a* and 24*b* are provided. In section III, copy paper often curls around heating roller 24*b* due to relatively strong adherence of toner on the paper.

In the present invention, a jammed copy paper at any of said areas may easily be removed by arranging the feeding path for the copy paper so that it is into a unit which can be withdrawn from the interior of the body proper of the copying apparatus in the feeding direction of the copy paper. More specifically, the feeding path leading from in front of feeding rollers 19*a* and 19*b* (i.e., excluding these rollers 19*a* and 19*b*) to the discharging end where paper receiving tray 26 is provided, is structured into a copy paper transporting unit A as indicated by one of the broken lines in FIG. 1. This unit A can be withdrawn in the right-hand direction as view in FIG. 1 so that a jammed paper may easily be removed. This also permits easy inspection of the copying apparatus as well as replacement of photosensitive drum 10.

The mechanism for withdrawing this copy paper transporting unit A will now be explained with reference to FIGS. 2A through 4.

The unit A is withdrawn in the feeding direction of the copy paper along a pair of slide rails 27, one being provided on each side of body proper 60 of the copying apparatus, one side of each rail being on the body 60 and the other being on the unit A itself. As can be best seen in FIGS. 2A, 2B and 3, a paper feeding unit 28 is formed adjacent one end of copy paper transporting unit A and includes spaced opposed side frames 29 which hold first paper cassette 18*a* and first feeding roller 19*a* therebetween. The numeral 36 designates a stack of sheets of copy paper stored in the cassette. At the front ends of both of these side frames 29, there is formed an indent 30 into which fits a positioning shaft 38. Also, at the lower part of the front end of each side frame 29, there is provided a first locking member 31 having an engaging notch 32. The lower leading end of each member 31 has an inclined face 33. This first locking member 31 is pivotable about an axis 31*a* and is normally urged downwardly by a spring 34, with its movement being restricted by a first stop 35.

The copy paper transporting unit A includes a pair of side frames 37 extending substantially the length of unit A. As has been mentioned, one side of each slide rail 27 is fixed on frame 37 and cooperates with the other side of slide rail 27 which is fixed on the body proper of the copying apparatus. The positioning shaft 38 briefly described above is fixedly provided between side frames 37 at one end thereof for engagement with indent 30 in each side frame 29. Also provided between side frames 37 is a locking shaft 40 which is rotatably supported and projects outwardly from one of the side frames 37. On this projecting end of locking shaft 40 there is mounted a locking lever 39, with the end thereof toward the paper feeding unit 28 being urged upwardly by a tension spring 43 and the other end being connected to one end of a chain 45. A second stop 48 projecting from side frame 37 restricts the counter-clockwise rotation of locking lever 39. A pair of locking arms 42, each having a second locking member 41, are fixedly attached on the locking shaft 40 in positions between side frames 37 but close to the inner faces of frames 37. As can be seen, the rotation of locking shaft 40 will cause locking lever 39 and locking arms 42 to rotate therewith.

Cooperating with chain 45, which has one end fixed to the locking lever 39, is a first sprocket 44 rotatably supported on side frame 37 at a position close to locking lever 39. At the far right end of unit A as viewed in FIGS. 2A and 2B, a second sprocket 47, with which chain 45 is meshed, is rotatably mounted on a handle shaft 46*a* extending through body proper 60. The outer end of this shaft 46*a* carries a manually rotatable handle 46 for rotating second sprocket 47. Chain 45 extends from locking lever 39 and meshes with first and second sprockets 44 and 47, and the other end of chain 45 is fixed to a retaining member 45*a* fixed on side frame 37.

Figure 2A:
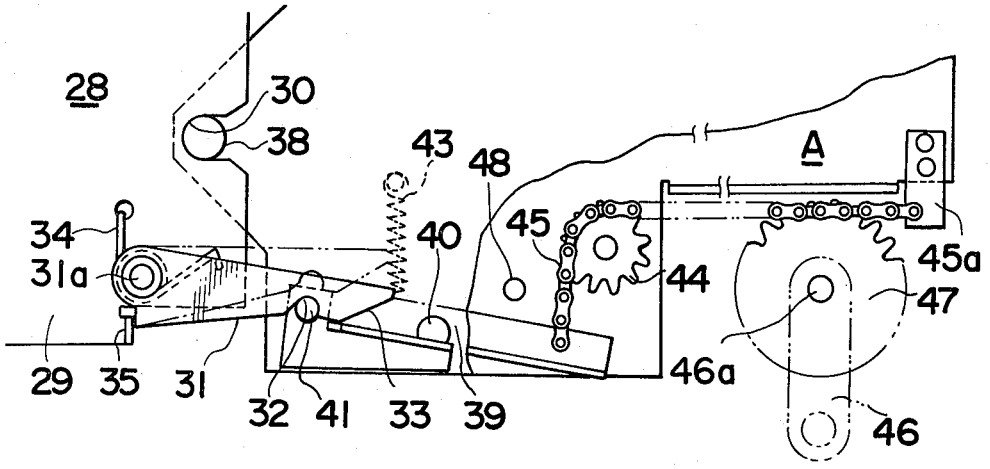

Normally the copy paper transporting unit A is in the locked position in the copying apparatus as shown in FIG. 2A. More specifically, positioning shaft 38 of unit A is fully engaged in indents 30 in side frames 29 of feeding unit 28. Similarly, second locking members 41 of locking arms 42 are respectively engaged in engaging notches 32 of first locking members 31 provided on side frames 29. This locked position is maintained by the upward urging force of tension spring 43 connected to locking lever 39.

Figure 2B:
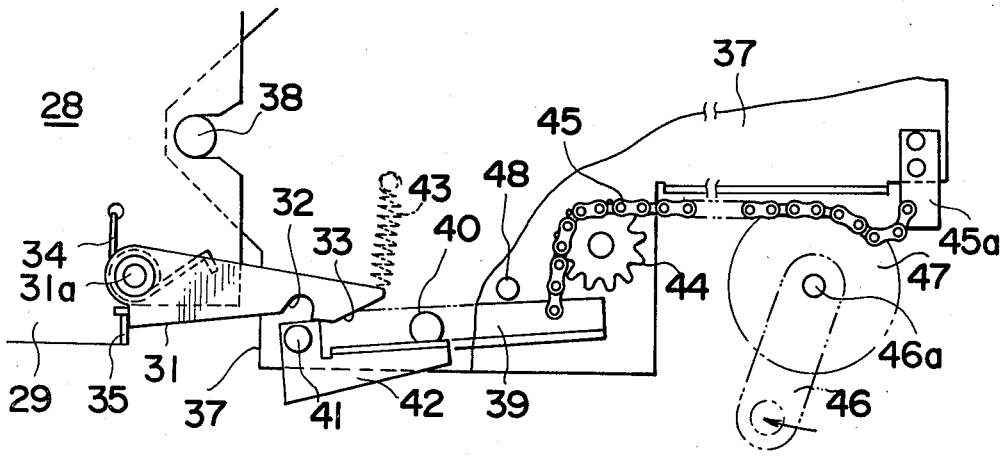
Figure 3:
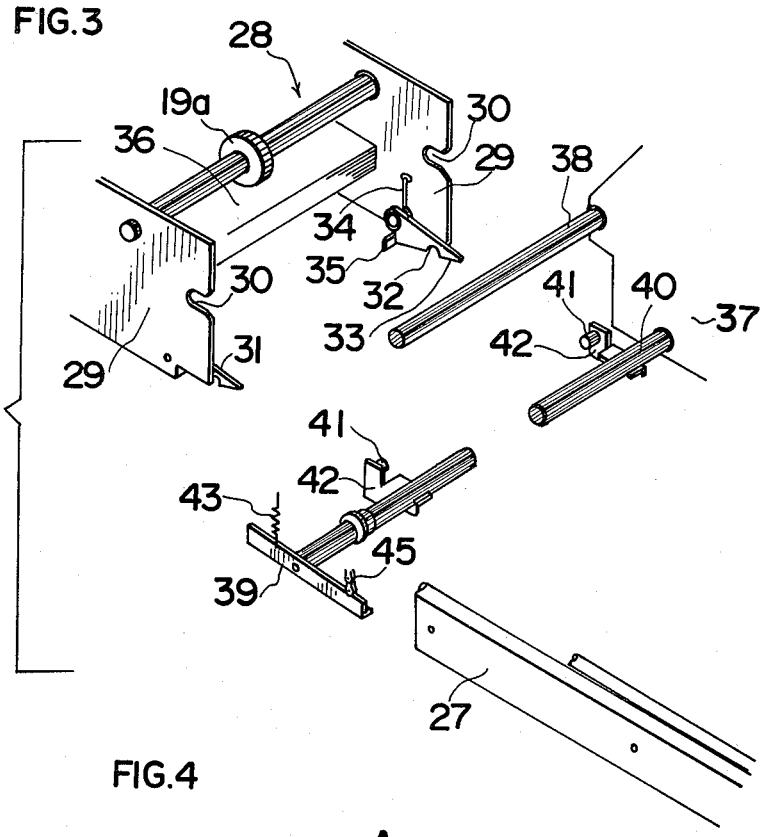
FIG. 3 is an exploded perspective view of a locking mechanism for the copy paper transporting unit of the present invention.
Figure 4:
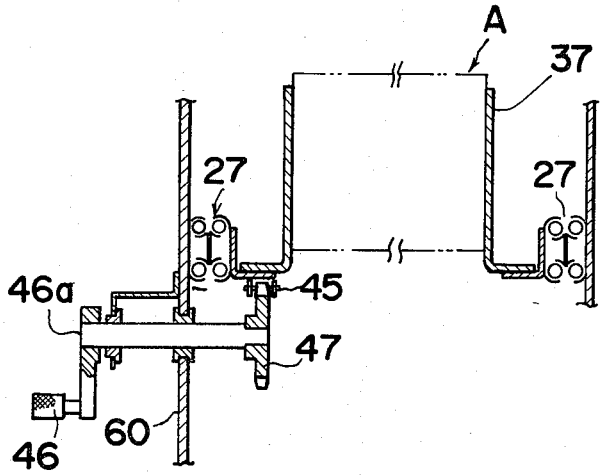
FIG. 4 is a cross-sectional view showing the relation among the copy paper transporting unit, handle and slide rails.

If for some reason, such as for removal of jammed copy paper, the copy paper transporting unit A is to be withdrawn from the interior of the copying apparatus, handle 46 is manually rotated in the clockwise direction as shown in FIG. 2B. The rotation of handle 46 causes second sprocket 47 to rotate therewith so as to drive chain 45 to the right, and the movement of chain 45 rotates locking lever 39, together with locking shaft 40, in the counter-clockwise direction, against the force of tension spring 43, until the rotation of locking lever 39 is restricted by second stop 48. Thus, the engagement of second locking members 41 with the engaging notches 32 of first locking members 31 is released. As handle 46 is further rotated, sprocket 47 drives chain 45 to the right, pulling unit A with it, and positioning shaft 38 disengages from indents 30. As rotation of handle 46 is continued, unit A is moved further to the right so as to be withdrawn from the interior of the copying apparatus. It is to be noted that about 70–80% of the full length of unit A is withdrawn from the interior of the apparatus in its fully withdrawn position.

With the unit A withdrawn from the interior of the apparatus, jammed copy paper may be removed. It should be noted that the unit A itself is so designed that its interior is accessible from the top and front of the unit at various areas. To reposition the unit A, it is only required to rotate handle 46 in the counter-clockwise direction, or even to just push the unit A itself to the left. As the unit A slides back, second locking members 41 of locking arms 42 contact inclined faces 33 of first locking members 31 so as to pivot the latter upward against the urging force of springs 34, and as the unit A is moved further to the left, second locking members 41 engage engaging notches 32 of first locking members 31. At this time, positioning shaft 38 locks into indents 30 simultaneously so that the unit A is fully locked in the apparatus.

Figure 5:
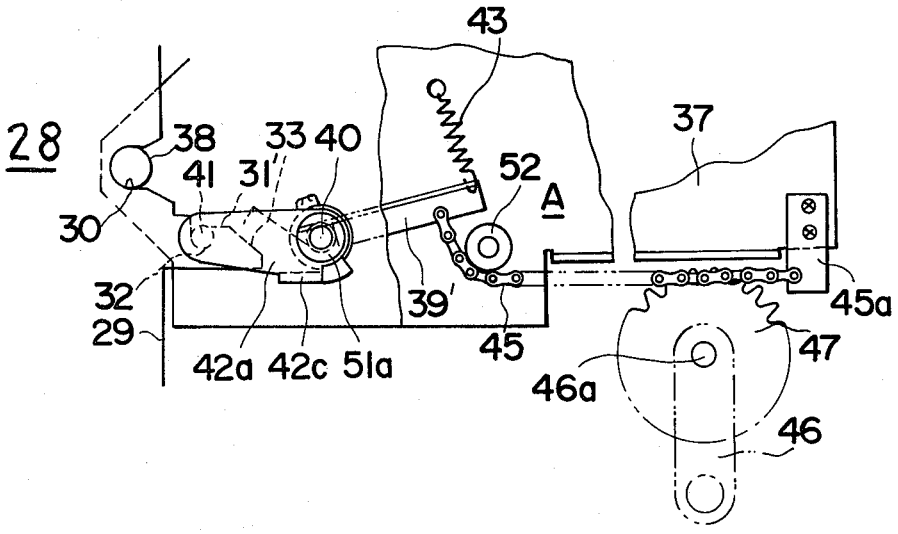
FIG. 5 is a side view of a locking mechanism according to another embodiment of the present invention.
Figure 6:
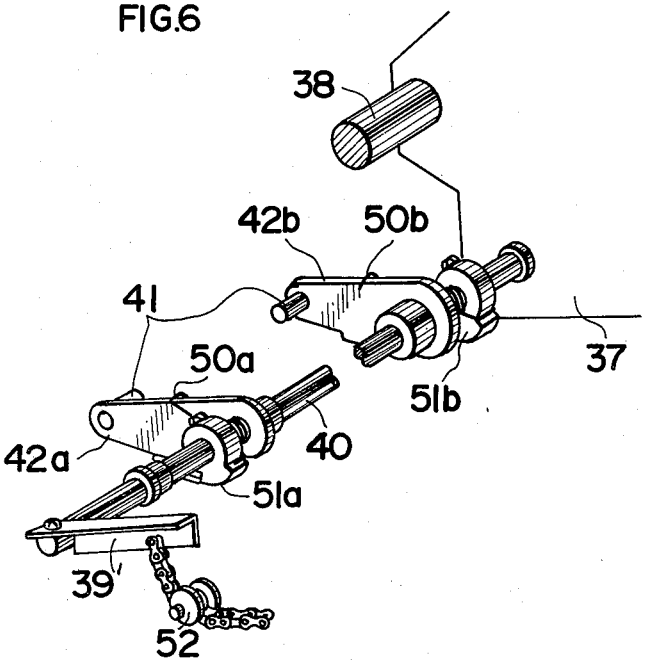
FIG. 6 is a perspective view showing details of the locking mechanism of FIG. 5.

Reference will now be made to FIGS. 5 and 6, showing another embodiment of a mechanism for the copy paper transporting unit A in accordance with the present invention. It should be noted that like parts will be designated by the same numerals as above, and modified parts will be designated by primed numerals.

As shown in FIGS. 5 and 6, side frames 29 of feeding unit 28 are designed to have indents 30 as well as first locking members 31'. Each locking member 31' is shaped so as to project from the end of side frame 29 and has an engaging notch 32 and an inclined face portion 33 at its leading end. On the rotatably supported locking shaft 40 running between and through side frames 37 of copy paper transporting unit A, there is rotatably provided a pair of locking arms **42*a* and 42*b*, each having a second locking member 41 engagable with engaging notches 32 of first locking members 31'. Adjacent each of locking arms 42*a* and 42*b* are stop members 51*a* and 51*b* fixedly provided on shaft 40 with each retaining one end of springs 50*a* and 50*b*. The other end of each spring 50*a* and 50*b* is engaged with a respective one of the locking arms 42*a* and 42*b* so as to urge these locking arms in the counter-clockwise direction. It should be realized that locking arms 42*a* and 42*b* are rotatably supported on shaft 40, whereas stop members 51*a* and 51*b* are fixedly attached on shaft 40. For this purpose, the lower portions of locking arms 42*a* and 42*b* have projecting portions 42*c* which contact stop members 51*a* and 51*b* when the locking arms 42*a* and 42*b* are at the positions on shaft 40 as shown in FIG. 6. A locking lever 39' is provided at the end of locking shaft 40, fixed thereto by a screw. This locking lever 39' is urged upwardly by a tension spring 43 and carries one end of chain 45. The other end of chain 45 is fixed to retaining member 45*a* provided at the right end of side frame 37, and chain 45 is guided around roller 42 and meshes with sprocket 47. By the use of roller 52 instead of sprocket 44, as well as by disposing chain 45 to run beneath roller 52, the unit A can be withdrawn further from the interior of the copying apparatus than in the case of the first embodiment, i.e. that shown in FIGS. 2A and 2B. This is apparent since the limit to which the unit A can be withdrawn in the first embodiment is where sprocket 44 contacts sprocket 47**.

To release the copy paper transporting unit A from the locked position shown in FIG. 5, handle 46 is rotated clockwise thereby causing locking lever 39' to be pulled downwardly against the tension of spring 43. By this action, locking shaft 40 is rotated, causing second locking members 41 of locking arms **42*a* and 42*b* to disengage from engaging notches 32 of first locking members 31'. With this, positioning shaft 38 also disengages from indents 30, and as handle 46 is further rotated, the unit A is moved by cooperation of chain 45, roller 52 and sprocket 47. When the unit A is to be repositioned fully back into the interior of the apparatus, handle 46 is rotated counter-clockwise, or unit A is merely pushed, and as the unit A is moved, second locking members 41 of locking arms 42*a* and 42*b* first come into contact with inclined faces 33 of first locking members 31' and slide therealong against the urging forces of springs 50*a* and 50*b*, and with further movement of unit A, second locking members 41 come into engagement with engaging notches 32 of first locking members 31'. At this time, positioning shaft 38 also fits into indents 30** so that the unit is fully locked in the apparatus.

While preferred embodiments of the present invention have been described, it is apparent that numerous alterations, additions and omissions may be made without departing from the spirit of the invention. For example, the sprocket 47 may be driven by a motor so that copy paper transporting unit A can be withdrawn from and moved back into the apparatus automatically.

I claim:

1. An electrophotographic copying apparatus which comprises:

a body proper and a copy paper transporting unit which cooperate with each other to provide a path for a copy paper through said apparatus, said body proper including a copy paper storing means provided with a feeding means for feeding said copy paper into said apparatus, said path extending from immediately in front of said feeding means to a discharge end in said transporting unit, said transporting unit being mounted in said body proper for partial withdrawal from said body proper in the direction of feeding of said copy paper;

a first locking means on said body proper;

a second locking means on said transporting unit and being releasably engageable with said first locking means; and releasing means connected to at least one of said locking means for releasing engagement of said second locking means from said first locking means to permit partial withdrawal of said transporting unit from said body proper, said releasing means comprising a first rotatable means, a second rotatable means, a chain cooperating with said first and second rotatable means and connected to said second locking means, and a third rotatable means connected to said second rotatable means to rotate said first and second rotatable means to move said chain to thereby release said second locking means from engagement with said first locking means.

2. An apparatus as claimed in claim 1, wherein said body proper includes supporting means for supporting said storing means and said feeding means, and said first locking means is provided on said supporting means.

3. An apparatus as claimed in claim 2, wherein said transporting unit includes positioning means to position said transporting unit in intimate contact with said body proper, and said supporting means are provided with indents for receiving said positioning means.

4. An apparatus as claimed in claim 3, wherein said transporting unit has spaced opposed side frames, and said positioning means in a shaft fixedly provided between said side frames.

5. An apparatus as claimed in claim 2, wherein said first locking means comprises a pivotable locking member having a lower edge, said lower edge having a leading end with an inclined face and an indented engaging notch behind said inclined face, and a spring urging said locking member downwardly.

6. An apparatus as claimed in claim 2, wherein said first locking means comprises a locking member fixed on said body proper and having an upper edge, said upper edge having a leading end with an inclined face and an indented engaging notch behind said inclined face.

7. An apparatus as claimed in claim 1, wherein said transporting unit has spaced opposed side frames, and said second locking means comprises a shaft rotatably supported between said side frames, one end of said shaft projecting from one of said side frames, said projecting end of said shaft having a lever fixed thereon, said shaft having a pair of locking arms fixedly attached to said shaft in a position between said side frames, each of said locking arms having a locking member thereon engagable with said first locking means.

8. An apparatus as claimed in claim 1, wherein said transporting unit has spaced opposed side frames, and said second locking means comprises a shaft rotatably supported between said side frames, one end of said shaft projecting from one of said side frames, said projecting end of said shaft having a lever fixed thereon, said shaft having a pair of locking arms rotatably supported on said shaft at positions between said side frames, each of said locking arms having a locking member thereon engagable with said first locking means, said shaft also having a pair of stop members fixedly attached to said shaft in positions respectively adjacent to each of said locking arms, said stop members respectively cooperating with said locking arms to restrict the rotation of said locking arms around said shaft, springs urging each of said locking arms into cooperation with said stop members, one end of each spring being retained by the corresponding locking arm and the other end being retained by the corresponding stop member.

9. An apparatus as claimed in claim 1, further comprising slide rails mounted between said body proper and said transporting unit on which said transporting unit is slidable to be withdrawn from said body proper.

10. An apparatus as claimed in claim 1, further comprising means connected to said second locking means for urging said second locking means into engagement with said first locking means.

11. An apparatus as claimed in claim 1, wherein said third rotatable means is a handle axially provided on said second rotatable means.

12. An apparatus as claimed in claim 1, wherein said first rotatable means is a first sprocket and said second rotatable means is a second sprocket, said first sprocket being positioned closer to said second locking means than said second sprocket.

13. An apparatus as claimed in claim 1, wherein said first rotatable means is a roller and said second rotatable means is a sprocket, said roller being positioned closer to said second locking means than said sprocket.

14. An electrophotographic copying apparatus which comprises:

a body proper and a copy paper transporting unit which cooperate with each other to provide a path for a copy paper through said apparatus, said body proper including a copy paper storing means provided with a feeding means for feeding said copy paper into said apparatus, said path extending from immediately in front of said feeding means to a discharge end in said transporting unit, said transporting unit being mounted in said body proper for partial withdrawal from said body proper in the direction of feeding of said copy paper;

a first locking means on said body proper;

a second locking means on said transporting unit and being releasably engagable with said first locking means;

releasing means connected to at least one of said locking means for releasing engagement of said second locking means from said first locking means to permit partial withdrawal of said transporting unit from said body proper; and withdrawing means for withdrawing said transporting unit from said body proper in the direction of feeding of said copy paper, said withdrawing means being operatively associated with said releasing means, said withdrawing means comprising a first rotatable means, a second rotatable means, a chain cooperating with said first and second rotatable means and connected to said second locking means, and a third rotatable means connected to said second rotatable means to rotate said first and second rotatable means to move said chain to thereby release said second locking means from engagement with said first locking means.

15. An apparatus as claimed in claim 14, wherein said third rotatable means is a handle axially provided on said second rotatable means.

16. An apparatus as claimed in claim 14, wherein said first rotatable means is a first sprocket and said second rotatable means is a second sprocket, said first sprocket being positioned closer to said second locking means than said second sprocket.

17. An apparatus as claimed in claim 14, wherein said first rotatable means is a roller and said second rotatable means is a sprocket, said roller being positioned closer to said second locking means than said sprocket.

18. An electrophotographic copying apparatus which comprises:

a body proper and a copy paper transporting unit which cooperate with each other to provide a path for a copy paper through said apparatus, said body proper including a copy paper storing means provided with a feeding means for feeding said copy paper into said apparatus, said path extending from immediately in front of said feeding means to a discharge end in said transporting unit, said transporting unit being mounted in said body proper for partial withdrawal from said body proper in the direction of feeding of said copy paper;

a first locking means on said body proper;

a second locking means on said transporting unit and being releasably engagable with said first locking means;

a rotatable means provided on said body proper at a position vicinal to said discharge end; and a flexible transmitting means cooperating with said rotatable means and connected to said second locking means to release said second locking means from engagement with said first locking means and withdraw said transporting unit from said body proper as said rotatable means is rotated in a single continuous action.

* * * * *